US006884952B2

(12) United States Patent
Mauroux et al.

(10) Patent No.: US 6,884,952 B2
(45) Date of Patent: Apr. 26, 2005

(54) CONTACT FINGER FOR A HIGH-POWER SWITCHGEAR

(75) Inventors: Jean-Claude Mauroux, Hunzenschwil (CH); Patrick Huguenot, Zurich (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 10/870,161

(22) Filed: Jun. 18, 2004

(65) Prior Publication Data

US 2005/0000944 A1 Jan. 6, 2005

(30) Foreign Application Priority Data

Jul. 2, 2003 (EP) ..... 03405494

(51) Int. Cl.[7] ..... H01H 1/50

(52) U.S. Cl. ..... 200/251; 200/283; 218/16; 218/48

(58) Field of Search ..... 218/48, 45, 50, 218/65, 12, 16–21, 1, 7; 200/239–246, 250, 252, 257, 260, 275, 283, 290, 48 R, 48 K, 48 B

(56) References Cited

U.S. PATENT DOCUMENTS

| | | | | |
|---|---|---|---|---|
| 1,699,858 A | | 1/1929 | Russell | |
| 2,256,734 A | | 9/1941 | Cornell et al. | |
| 4,715,834 A | | 12/1987 | Thuries et al. | |
| 4,939,322 A | * | 7/1990 | Kashimura et al. | 218/62 |
| 5,483,031 A | | 1/1996 | Matsuda | |
| 5,981,893 A | * | 11/1999 | Bleiker et al. | 218/48 |
| 6,100,492 A | * | 8/2000 | Zehnder et al. | 218/146 |
| 6,259,050 B1 | * | 7/2001 | Zehnder et al. | 218/118 |

FOREIGN PATENT DOCUMENTS

| | | |
|---|---|---|
| CH | 645 204 A5 | 9/1984 |
| DE | 37 36 835 A1 | 5/1989 |
| DE | 196 48 633 A1 | 5/1998 |
| DE | 198 16 508 A1 | 10/1999 |

* cited by examiner

*Primary Examiner*—Lincoln Donovan
*Assistant Examiner*—M. Fishman
(74) *Attorney, Agent, or Firm*—Burns, Doane, Swecker & Mathis, L.L.P.

(57) ABSTRACT

A contact finger module for mounting in a high-power switchgear includes at least one contact finger having a contact piece and a flexible contact piece support, which extends along a longitudinal direction and has an attachment end and a contact-making end. The contact piece overhangs the contact piece support in the opposite direction to a deflection direction, and is connected to the contact piece support at the contact-making end. The contact finger module includes at least one leaf spring, which extends along the longitudinal direction and has an attachment end at which it is connected to the attachment end of the contact piece support in the mounted state. The leaf spring can produce a force that counteracts deflection of the contact piece in the deflection direction. In the mounted state, the leaf spring can extend in the longitudinal direction at least as far as the center of the extension of the contact piece in the longitudinal direction.

20 Claims, 2 Drawing Sheets

CONTACT FINGER FOR A HIGH-POWER SWITCHGEAR

TECHNICAL FIELD

The invention relates to the field of high-voltage switching technology, in particular to contact fingers, such as those used in high-power switchgears, in particular, in disconnectors. It relates to a contact finger module, to a disconnector module and to a high-power switchgear.

PRIOR ART

Contact finger modules are known from the prior art, which comprise a leaf spring that extends along a longitudinal direction and a contact finger, having a contact piece and a flexible contact piece support which extends along a longitudinal direction. Contact finger modules such as these are used in disconnector modules in high-power switchgears, for example generator switches, in order to make contact with the isolator tube.

At an end which faces away from the attachment end of the contact finger, the contact piece projects beyond the flexible contact piece support in the opposite direction to the deflection direction, which is aligned essentially at right angles to the longitudinal direction. The flexible contact piece support and the contact piece are connected to one another by means of a screw connection, which runs through the flexible contact piece support and centrally into the contact piece. An isolating platelet which is arranged on the side of the flexible contact piece support facing away from the contact piece is arranged between the contact piece support and the head of the screw of the screw connection and extends in the longitudinal direction, beyond the contact piece, in the direction of the attachment end.

The leaf spring is curved in the form of an arc over virtually its entire length and, in the mounted state, extends from the attachment end in the longitudinal direction to a point in front of the contact piece and as far as the isolating platelet. In the mounted state, the leaf spring rests on the isolating platelet such that the leaf spring can produce a force which counteracts any deflection of the contact piece in the deflection direction, without any current flowing through the leaf spring into the contact piece. At the end of the leaf spring which rests on the isolating platelet, the leaf spring has a bend which continues away from the flexible contact piece support, resulting in the production of an end of the leaf spring which, in the mounted state, includes an angle of about 20° with the longitudinal direction and continues away from the contact piece support.

A contact finger module such as this has the disadvantage that the field control is poor, since the contact piece and the flexible contact piece support, as well as the head of the screw of the screw connection as well as the end of the leaf spring which continues away from the contact piece support lead, at the contact-making end, which faces away from the attachment end, to a non-uniform field distribution with strong electrical fields at the edges and ends of the contact finger module.

DESCRIPTION OF THE INVENTION

The object of the invention is therefore to provide a contact finger module of the type mentioned initially which does not have the disadvantages mentioned above.

One particular aim is to achieve good field control in the area of the contact pieces.

This object is achieved by apparatuses having features described herein.

The contact finger module according to the invention for mounting in a high-power switchgear includes:

at least one contact finger having a contact piece and a flexible contact piece support which extends along a longitudinal direction and has an attachment end and a contact-making end, with the contact piece overhanging the contact piece support in the opposite direction to a deflection direction, and being connected to the contact piece support at the contact-making end, and at least one leaf spring which extends along the longitudinal direction and has an attachment end at which it is connected to the attachment end of the contact piece support in the mounted state, with the leaf spring being designed, and being arranged when in the mounted state, such that it can produce a force which counteracts any deflection of the contact piece in the deflection direction.

The contact finger module according to the invention is characterized in that when in the mounted state, the leaf spring extends in the longitudinal direction at least as far as the center of the extension of the contact piece in the longitudinal direction.

This results in improved field control in the area of the contact pieces. Field strength peaks which are arranged at the corners or edges of the contact finger module close to the contact-making end are at least partially shielded. The risk of electrical flashovers is reduced.

Instead of being used exclusively only to produce a sufficient contact pressure of the contact piece on a further contact piece which, together with it, forms a detachable electrical contact, the leaf spring additionally carries out field control tasks.

In one preferred embodiment of the subject matter of the invention, in the mounted state, the leaf spring extends in the longitudinal direction at least as far as the end of the extension of the contact finger in the longitudinal direction. This results in even better field control.

In a further preferred embodiment of the subject matter of the invention, the point at which the force is introduced from the leaf spring into the contact finger is located, with respect to the longitudinal direction, in the center of the extension of the contact piece in the longitudinal direction, or on the side of this center facing away from the attachment end.

The leaf spring thus produces a relatively large contact pressure (large contact force, on the contact piece with a relatively small bias stress, and this contact pressure can be exerted by the pressure of the leaf spring on the contact finger by the contact piece.

In a further, particularly preferred embodiment of the subject matter of the invention, the leaf spring projects beyond the contact finger in the longitudinal direction in the mounted state. This results in particularly good field control by the leaf spring.

In a further advantageous embodiment, the leaf spring is bent in the opposite direction to the deflection direction at the end facing away from its attachment end, or is bent through at least 180° in the deflection direction. In this way, field peaks which may occur on exposed edges of the leaf spring are largely avoided, thus resulting in a largely homogeneous field distribution and correspondingly good field control.

The leaf spring is particularly advantageously bent through at least 180°, in particular through more than 185°, in the opposite direction to the deflection direction at its end facing away from its attachment end. In this way, field peaks which may be formed on exposed edges of the leaf spring are avoided particularly well, thus resulting in a largely homogeneous field distribution and correspondingly particularly good field control.

In the unmounted state, the leaf spring is advantageously not curved between its ends. In particular, it is also not curved at its attachment end. A leaf spring such as this can be produced reproducibly and easily, that is to say tight tolerances can be specified, and it is possible to achieve only a small amount of scatter in the contact forces.

Nevertheless, a leaf spring such as this can exert a sufficiently large force on the contact finger.

The flexible contact piece support very advantageously includes a lamella stack composed of electrically conductive lamellae. Silver-plated copper lamellae, in particular with thicknesses of between 0.1 mm and 0.7 mm, and preferably between 0.15 mm and 0.3 mm, are advantageously used.

The contact piece support is particularly advantageously arranged above the contact piece in the deflection direction, with the contact piece support and the contact piece being fixed to one another by means of a radial rivet. In comparison to the known screw connections between the contact piece and the flexible contact piece support, a radial rivet (which is also referred to as a swiveling joint) has long-term stability, thus resulting in better constancy of the contact pressure over a large number of opening/closing cycles of a contact which is produced by means of the contact finger module. Furthermore, the swiveling joint is a captive joint.

One embodiment of the subject matter of the invention, in which the contact finger module has two or three contact fingers each having at least one contact piece and each having at least one flexible contact piece support is particularly advantageous, with the contact piece support having a common attachment end, and having two or three leaf springs which have a common attachment end with in each case one leaf spring interacting with each contact finger such that the leaf spring can produce a force which counteracts any deflection of the contact piece of the contact finger in the deflection direction; and with each leaf spring extending, in the mounted state, in the longitudinal direction at least to the center of the extension of the respective contact piece in the longitudinal direction.

Two or three leaf springs are thus in each case formed in one, preferably integral, component, and two or three contact fingers are in each case combined in one component, which may be integral. However, the component which includes the contact fingers advantageously has two or three contact pieces, and one component has the two or three flexible contact piece supports. The latter component may, for example, be integral or, in the case of a lamella stack, the individual lamellae of the two or three flexible contact piece supports are advantageously formed integrally.

This simplifies the installation of the contact fingers, making it possible to simplify the production of the contact finger module.

The high-power switchgear according to the invention with a large number of contact finger modules which act as part of a detachable electrical contact is characterized according to the invention by having contact finger modules. The advantages are those mentioned above. The contact finger modules are preferably used in the rated current circuit and/or in the disconnector of the high-power switchgear. Typical rated currents and voltages which are switched by a high-power switchgear such as this are between 6 kA and 40 kA at 1 kV to 50 kV.

The disconnector module according to the invention for a high power switchgear has at least one drive housing and a moveable disconnector tube, and has a large number of contact finger modules which are arranged on the drive housing or on the disconnector tube and act as part of a detachable electrical contact between the disconnector tube and the drive housing. This is characterized by having contact finger modules according to the invention. The advantages are the same as those stated above.

Further preferred embodiments and advantages will become evident from the dependent patent claims and from the figures.

BRIEF DESCRIPTION OF THE DRAWINGS

The subject matter of the invention will be explained in more detail in the following text with reference to preferred exemplary embodiments which are illustrated in the attached drawings, in which.

Figure 1:
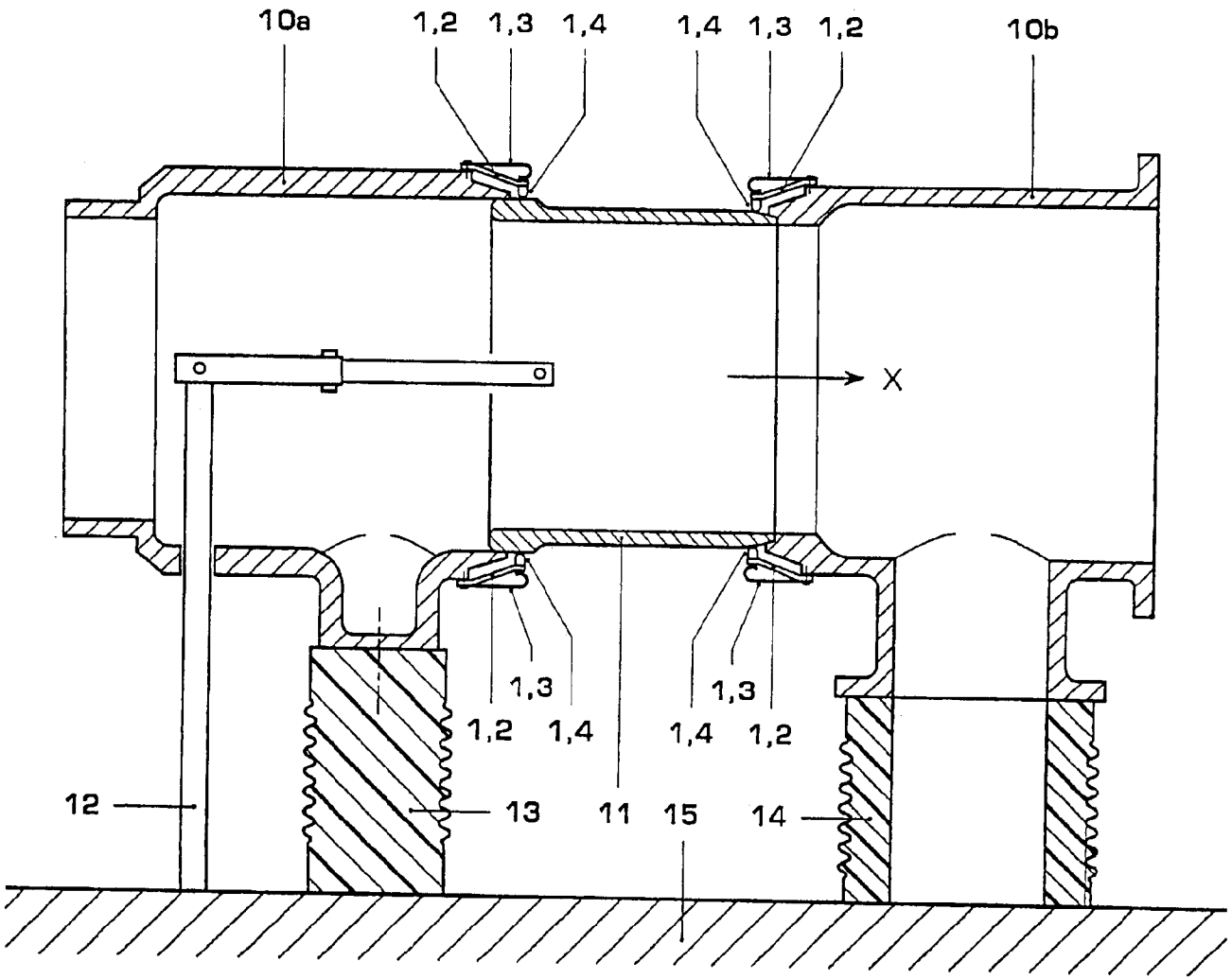
FIG. 1 shows an disconnector module according to the invention, partially sectioned and schematically.

The reference symbols used in the drawings and their meaning are listed in summarized form in the list of reference symbols. In principle, identical parts or parts having the same effect are provided with the same reference symbols in the figures. The described exemplary embodiments represent examples of the subject matter of the invention and have no restrictive effect.

Approaches to Implementation of the Invention

FIG. 1 shows, schematically, an disconnector module according to the invention in the closed state and in the form of a partial section. The disconnector module is provided as part of a high-power switchgear, in particular of a high-current switch or generator switch. The disconnector module has an disconnector drive housing 10*a* and an arcing chamber drive housing 10*b* as well as an disconnector tube 11. The disconnector module is part of the active part of the high-power switchgear, and the two drive housings 10*a*, 10*b* are mounted on isolators 13, 14 on a base plate 15, which is at ground potential.

The disconnector tube 11 is used to produce a visible isolating gap. The disconnector tube 11 can be moved by means of a drive 12, which is indicated schematically, along an axis which runs parallel to a longitudinal direction x that is illustrated in FIG. 1. When the disconnector module is in the closed state as shown in FIG. 1, the disconnector tube 11 makes electrical contact at both of its ends with contact finger modules 1. A large number of contact finger modules 1 are arranged on the disconnector drive housing 10*a* and on the arcing chamber drive housing 10*b*, in each case along a circumference of the respective drive housing 10*a*, 10*b*. The contact finger modules 1 each include at least one contact finger 2 with a contact piece 4 as well as at least one leaf spring 3. The contact finger modules 1 are described in more detail in FIGS. 2 and 3.

In order to produce the visible isolating gap, the disconnector tube 11 is moved in the opposite direction to the longitudinal direction x, so that the contact finger modules 1 which are on the arcing chamber drive housing side no longer make electrical contact with the disconnector tube 11, and a sufficient gap is produced between the drive chambers 10*a*, 10*b*. In the closed state, the leaf springs 3 produce a contact pressure which pushes the contact pieces 4 against the disconnector tube 11.

In order to close the disconnector module, the disconnector tube 11 is moved in the longitudinal direction x, so that both the contact finger modules 1 which are on the disconnector drive housing side and the contact finger modules 1 which are on the arcing chamber drive housing side make contact with the disconnector tube 11.

As can be seen from FIG. 1, on the disconnector drive housing side, the disconnector tube 11 has an external diameter which runs in the form of a rounded step along the longitudinal direction x. The contact finger modules 1 which are on the disconnector drive housing side also make electrical contact with the disconnector tube 11 in the open state; the contact pieces 4 on the disconnector drive housing side are then supported on the disconnector tube 11 in an area in which the disconnector tube has a reduced external diameter. In this state, the leaf springs 3 are mechanically prestressed, by which means contact pieces 4 are pushed against the disconnector tube 11. A low ratio of this mechanical prestress to the contact pressure with which the contact pieces 4 are pressed by the leaf springs 3 against the disconnector tube in the closed state is highly advantageous, resulting in a reduced insertion force for the disconnector tube 11 during switching and reduced wear on the contact pieces 4 with an adequately high contact pressure. The stated ratio is low as a result of the location at which the force is introduced % from the leaf spring 3 into the contact finger 2 at the contact-making end being arranged such that it is particularly wide. With regard to the contact finger module 1 on the arcing chamber drive housing side, an arrangement of the location at which the force is introduced from the leaf spring 3 into the contact finger 2 for a given contact pressure which is particularly wide at the contact-making end means a reduction in the mechanical insertion resistance during closing of the disconnector. This is because, in this case, as well, the ratio of the mechanical prestress produced by the leaf springs 3 to the contact pressure is low.

During closure of the disconnector module, all of the contact pieces 4 are deflected along a deflection direction which points radially outward and is thus aligned at right angles to the longitudinal direction x. Contact forces to produce suitable contact pressures are typically between 20 N and 40 N per contact piece 4, in particular between 25 N and 35 N. Corresponding prestressing forces per contact piece 4 are typically between 10 N and 20 N, in particular between 12 N and 18 N.

A high-power switchgear according to the invention may include an disconnector module such as that illustrated in FIG. 1, with the disconnector drive housing 10*a* then advantageously being arranged on the power supply system side, while the arcing chamber drive housing 10*b* is connected to an arcing chamber that is not illustrated but is arranged on the generator side.

Contact finger modules 1 according to the invention can also be used at other switching points or contact points in high-power switchgears, for example in the arcing chamber or in some other way preferably in the rated current circuit, in particular in conjunction with wear-resistant contact parts.

Figure 2:
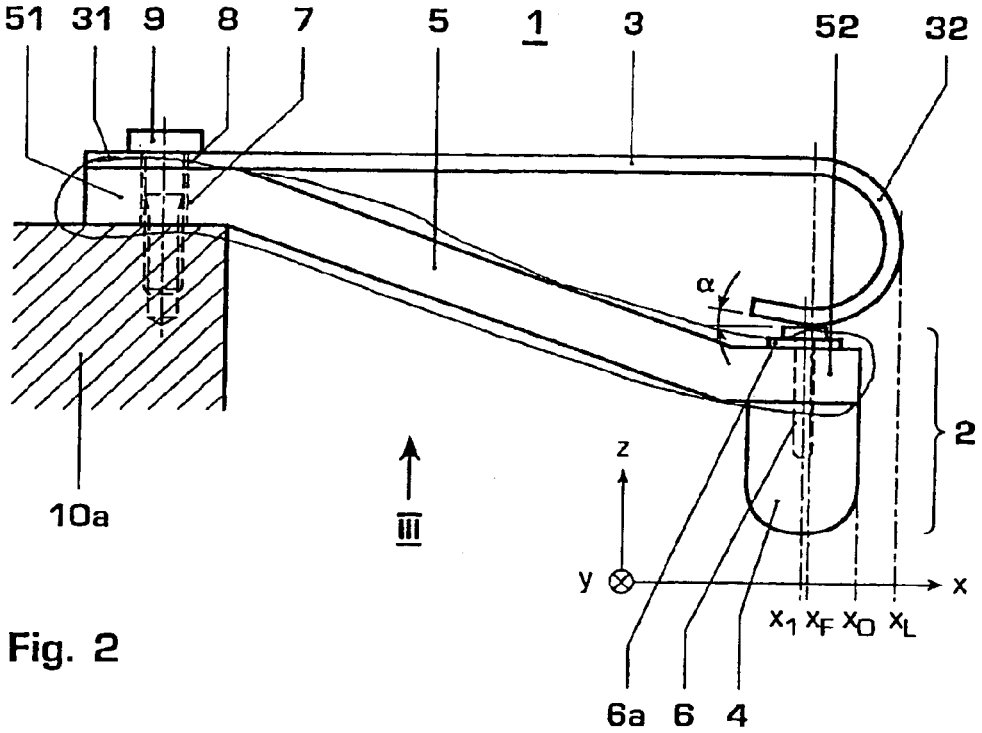
FIG. 2 shows a contact finger module according to the invention in the mounted state, sectioned.

FIG. 2 shows a contact finger module 1 according to the invention in the form of a section in the mounted state, corresponding to one of the contact finger modules 1, illustrated in FIG. 1. The contact finger module 1 is fixed by means of a screw connection 9 on the disconnector drive housing 10*a*, which is illustrated only by way of indication, and this screw connection 9 at the same time also fixes the leaf spring 3 on the contact finger 2, or, to be more precise, a flexible contact piece support 5 of the contact finger 2. The ends 31, 51 of the leaf spring 3 or of the flexible contact piece support 5, respectively, on which the leaf spring 3 or the flexible contact piece support 5, respectively, is mounted on the high-power switchgear, are referred to as attachment ends 31, 51. The leaf spring 3 and the contact piece support 5 each have a hole 7, 8 as attachment means holders 7, 8. The flexible contact piece support 5 extends along the longitudinal direction x and, in addition, also has an extension along the deflection direction, which is annotated z. This is optional, and is advantageously produced by one or two kinks or bends in the contact piece support 5, and is preferably aligned in the opposite direction to the deflection direction z.

The contact piece support 5 is connected to the contact piece 4 at a further end 52 of the contact piece support 5, which is referred to as the contact-making end 52. This projects beyond the contact piece support in the opposite direction to the deflection direction z. The connection between the contact piece support 4 and the contact piece 4 is advantageously formed by a swiveling joint 6, which is also referred to as a radial rivet 6. Other form-fitting, interlocking or integral connections are also possible. A washer 6*a* may be arranged between the flexible contact piece support 5 and the head of the radial rivet 6.

The contact piece 4 is used to make contact with a second contact piece which is not illustrated but can move relative to the contact finger module 1 along the longitudinal direction x, and can form a detachable electrical contact with the contact piece 4 (in the closed state). In the configuration shown in FIG. 1, this second contact piece is formed by the disconnector tube 11. In order to form the electrical contact (switching on), the contact piece 4 is deflected in the deflection direction z at right angles to the longitudinal direction x, owing to the relative movement of the contact pieces along the longitudinal direction. The contact piece 4 is composed of a material having high electrical conductivity, in particular of copper, which advantageously has a silver coating.

The flexible contact piece support 5 is advantageously in the form of a lamella stack. The lamellae are composed of a material of high electrical conductivity and may have an electrically conductive coating. The lamellae are preferably produced from copper and advantageously have a silver coating. The individual lamellae are advantageously identical and have a typical thickness of between 0.1 mm and 0.7 mm, preferably between 0.15 mm and 0.3 mm. This makes it possible to achieve a suitable elastic deformation capability for the flexible contact piece support 5, with high electrical conductivity.

The preferably metallic, in particular steel, leaf spring 3 is arranged on the side of the flexible contact piece support 5 which faces away from the contact piece 4. Except at its end 32, it is not curved and advantageously extends, as is illustrated in FIG. 2, along the longitudinal direction x. At its end 32, the leaf spring 3 is bent through more than 180° in the opposite direction to the deflection direction z. It could also be bent through a lesser angle. The last piece of the end 32 of the leaf spring 3 includes an angle $\alpha$, which is advantageously at least 5° or at least 10° within the axis of the longitudinal direction.

The bending through more than 180° results in secure contact between the leaf spring 3 and the contact finger 2, and a long lever arm for the leaf spring 3. With regard to the longitudinal direction x, the contact point of the leaf spring 3, or the point at which the force is introduced, for a longitudinal coordinate which is referred to as $x_F$ and is further away from the attachment end 31 than the longitudinal coordinate $x_1$, is located at the center of the contact piece 4.

The leaf spring extends as far as the longitudinal direction coordinate $x_L$ in the longitudinal direction x.

In FIG. 2, this is arranged on the side of the longitudinal direction coordinate $x_1$ which faces away from the attachment end 31, 51 and is referred to as the center of the extension of the contact piece 4 in the longitudinal direction. Furthermore, $x_L$ is arranged on the side of a longitudinal direction coordinate $x_0$ which faces away from the attachment end 31, 51 and is referred to as the end of the extension of the contact finger 2 in the longitudinal direction.

The contact piece 4 does not necessarily end flush with the contact-making end 52 of the contact piece support 5 in the longitudinal direction x, as is illustrated in FIG. 2. The contact piece 4 may project beyond the contact piece support 5 in the longitudinal direction x, or vice versa. The contact piece 4 is, however, arranged at the contact-making end 52 of the contact piece support 5, and its longitudinal extension is a good measure for the size of the contact finger module 1. A good field control effect by the leaf spring 3 is achieved just by the leaf spring 3 extending in the longitudinal direction x at least to the center $x_1$ of the extension of the contact piece 4 in the longitudinal direction x.

There is no need for the leaf spring 3 to be supported on an isolation platelet instead of directly on the contact finger 2. Experiments and simulations have shown that path currents which flow through the leaf spring 3 from the attachment end 31 through the leaf spring 3 into the contact-making end 52 of the contact finger 2 do not lead to the leaf spring 3 being heated to such an extent that it loses its spring force to any relevant extent.

The leaf spring 3 may also be bent in the direction of the deflection direction z (not illustrated). In this case, bending through at least 180°, and if possible also greater than or equal to 270°, is advantageous in order to achieve good field control. If the leaf spring 3 is bent at its end 32 in the direction of the deflection direction z, the leaf spring 3 may advantageously be bent in the opposite direction to the deflection direction z between its ends 31, 32 and/or may extend in the opposite direction to the deflection direction z there (partially as well), and spacing means (not illustrated) may advantageously be arranged between the leaf spring 3 and the contact piece support 5 at the attachment end 31, 51, in order to make it easier for the leaf spring 3 to exert the contact pressure on the contact finger 2.

The contact finger module 1 shown in FIG. 2 may have one, two, three or more contact fingers 2 and leaf springs 3. The particularly advantageous embodiment with two contact fingers and two leaf springs is shown in FIG. 3.

Figure 3:
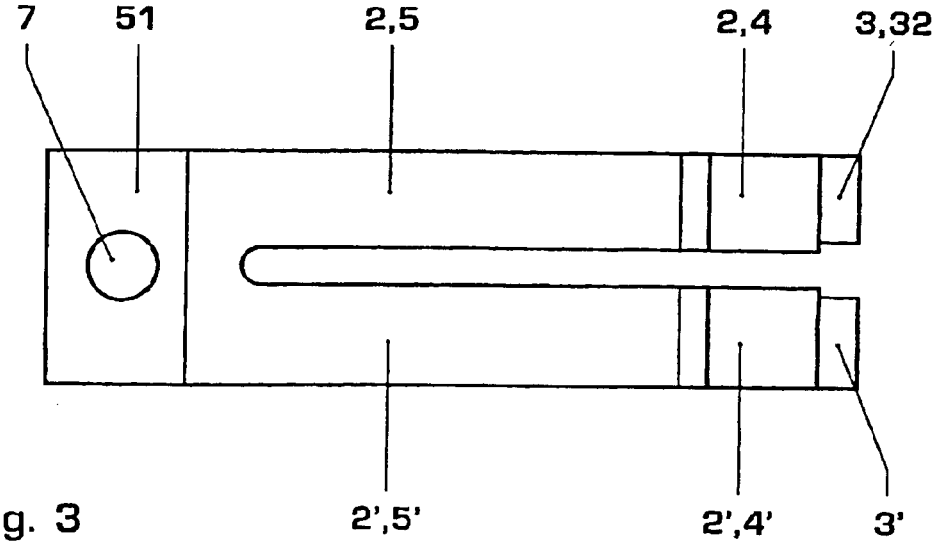
FIG. 3 shows a view of the contact finger module as shown in FIG. 2, along the direction annotated "III" in FIG. 2.

FIG. 3 shows a view of the corresponding contact finger module 1 as shown in FIG. 2 from the direction annotated "III" in FIG. 2. This shows two contact fingers 2, 2', having a respective flexible contact piece support 5, 5' and having a respective contact piece 4, 4', as well as two leaf springs 3, 3', which interact with the contact fingers 2, 2' in the manner described above. The two contact fingers 2, 2' (or, to be more precise, the two contact piece supports 5, 5') advantageously have a common attachment end 51. In addition, the two leaf springs 3, 3' also advantageously have a common attachment end 31 (although this cannot be seen in FIG. 3.

The respective two contact fingers 2, 2' and the two leaf springs 3, 3' are advantageously identical and advantageously also have the same effect. A contact finger 2 may be formed from two or more pieces, or else may be integral. Currents which flow continuously through a contact finger 2 in the closed state are typically between 80 A and 200 A, in particular between 100 A and 160 A. A contact finger module 1 which has two contact fingers 2, 2' carries currents that are twice as great, in a corresponding manner.

In the transverse direction that is annotated y in FIG. 2, the leaf springs 3, 3' may have the same width, may be broader or may advantageously be less broad than the flexible contact piece support 5, 5'.

LIST OF REFERENCE SYMBOLS

1 Contact finger module
2,2' Contact finger
3,3' Leaf spring
31 Attachment end of the leaf spring
32 End of the leaf spring
4,4' Contact piece
5,5' Flexible contact piece support, lamella stack
51 Attachment end of the flexible contact piece support
52 Contact-making end of the flexible contact piece support
6 Radial rivet, swiveling joint
6*a* Washer
7 Hole, attachment means holder
8 Hole, attachment means holder
9 Attachment means, screw
10*a* Disconnector drive housing
10*b* Arcing chamber drive housing
11 Disconnector tube
12 Disconnector drive
13 Isolator
14 Isolator
15 Base plate
x Longitudinal direction
$x_0$ End of the extension of the contact finger in the longitudinal direction
$x_1$ Center of the extension of the contact piece in the longitudinal direction
$x_F$ Point at which the force is introduced in the longitudinal direction
$x_L$ End of the extension of the leaf spring in the longitudinal direction
y Transverse direction
z Deflection direction

What is claimed is:

1. A contact finger module for mounting in a high-power switchgear, comprising:

at least one contact finger having a contact piece and a flexible contact piece support which extends along a longitudinal direction and has an attachment end and a contact-making end, with the contact piece overhanging the contact piece support in the opposite direction to a deflection direction, and being connected to the contact piece support at the contact-making end; and at least one leaf spring which extends along the longitudinal direction and has two ends one of which is an attachment end at which it the leaf spring is connected to the attachment end of the contact piece support in the mounted state;

the leaf spring being designed, and being arranged, when in the mounted state, such that the leaf spring can produce a force which counteracts any deflection of the contact piece in the deflection direction;

wherein, when in the mounted state, the leaf spring extends in the longitudinal direction at least as far as the center of the extension of the contact piece in the longitudinal direction.

2. The contact finger module as claimed in claim 1, wherein in the mounted state, the leaf spring extends in the longitudinal direction at least as far as the end of the extension of the contact finger in the longitudinal direction.

3. The contact finger module as claimed in claim 1, wherein the point, at which the force is introduced from the leaf spring into the contact finger, is, with respect to the longitudinal direction, located in the center of the extension of the contact piece in the longitudinal direction, or on the side of the center, which is facing away from the attachment end.

4. A contact finger module for mounting in high-power switchgear, comprising:

at least one contact finger which includes a contact piece and a flexible contact piece support which extends along a longitudinal direction and has an attachment end and a contact-making end, the contact piece overhangs the contact piece support in the opposite direction to a deflection direction, and is connected to the contact piece support at the contact-making end; and at least one leaf spring which extends along the longitudinal direction and has an attachment end at which it is connected to the attachment end of the contact piece support in the mounted state;

the leaf spring, when in the mounted state, can produce a force which counteracts any deflection of the contact piece in the deflection direction and extends beyond the contact finger in the longitudinal direction.

5. The contact finger module as claimed in claim 1, wherein at the end, which faces away from the attachment end, the leaf spring is bent in the direction opposite to the deflection direction, or is bent through at least 180° in the deflection direction.

6. The contact finger module as claimed in claim 5, wherein at the end which faces away from the attachment end, the leaf spring is bent through at least 180°, in the direction opposite to the deflection direction.

7. The contact finger module as claimed in claim 1, wherein in the unmounted state, the leaf spring is not curved between the ends of the leaf spring.

8. The contact finger module as claimed in claim 1, wherein the flexible contact piece support comprises a lamella stack composed of electrically conductive lamellae.

9. The contact finger module as claimed in claim 1, wherein the flexible contact piece support is arranged above the contact piece in the deflection direction.

10. The contact finger module as claimed in claim 1, comprising two or three contact fingers, each having at least one contact piece and each having at least one flexible contact piece support, with the contact piece supports having a common attachment end, and having two or three leaf springs which have a common attachment end, with one leaf spring in each case interacting with each contact finger such that the leaf spring can produce a force which counteracts any deflection of the contact piece of the contact finger in the deflection direction, and with each leaf spring extending, in the mounted state, in the longitudinal direction at least to the center of the extension of the respective contact piece in the longitudinal direction.

11. A high-power switchgear having a plurality of contact finger modules as claimed in claim 1 which act as part of a detachable electrical contact.

12. A disconnector module for a high-power switchgear, comprising at least one drive housing, a moveable disconnector tube and a plurality of contact finger modules as claimed in claim 1, which are arranged on the drive housing or on the disconnector tube and act as part of a detachable electrical contact between the disconnector tube and the drive housing.

13. The contact finger module as claimed in claim 1, wherein the leaf spring is arranged on the side of the flexible contact piece support that faces away from the contact piece.

14. The contact finger module as claimed in claim 5, wherein, at the end which faces away from the attachment end, the leaf spring is bent through more than 185° in the direction opposite to the deflection direction.

15. The contact finger module as claimed in claim 7, wherein, in the unmounted state, the leaf spring is also not curved at the attachment end.

16. The contact finger module as claimed in claim 8, wherein the lamella stack is composed of silver-plated copper lamellae.

17. The contact finger module as claimed in claim 8, wherein the thickness of the lamellae is between 0.1 mm and 0.7 mm.

18. The contact finger module as claimed in claim 9, wherein the flexible contact piece support and the contact piece are fixed to one another by a radial rivet.

19. The contact finger module as claimed in claim 1, wherein the contact piece support comprises a straight portion that extends from the attachment end to the contact-making end.

20. The contact finger module as claimed in claim 1, wherein the attachment end of the leaf spring is connected to the attachment end of the contact piece support by a screw.

* * * * *